US006792734B2

(12) United States Patent
Zambelli et al.

(10) Patent No.: US 6,792,734 B2
(45) Date of Patent: Sep. 21, 2004

(54) DEVICE FOR PROTECTING LIFTING INSERTS HAVING A TUBULAR BODY DURING THEIR EMBEDDING IN A PREFABRICATED CONCRETE COMPONENT

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 36 days.

(21) Appl. No.: 10/015,764

(22) Filed: Dec. 17, 2001

(65) Prior Publication Data

US 2002/0078637 A1 Jun. 27, 2002

(30) Foreign Application Priority Data

Dec. 21, 2000 (IT) ..... MI2000A2794

(51) Int. Cl.[7] ..... F04B 1/38; F04C 5/00

(52) U.S. Cl. ..... 52/698; 52/707; 52/125.1; 52/125.2; 52/701

(58) Field of Search ..... 52/707, 711, 704, 52/702, 699, 698, 125.5, 125.4, 125.1, 125.2, 125.3, 701; 294/89; 138/93, 94, 90

(56) References Cited

U.S. PATENT DOCUMENTS 3,705,469 A * 12/1972 Eriksson ..... 52/125.4
3,873,147 A * 3/1975 Annable et al. ..... 294/89
4,068,878 A * 1/1978 Wilner ..... 294/82.17
4,179,151 A * 12/1979 Tye ..... 294/89
4,209,163 A * 6/1980 Nordskog ..... 251/96
5,604,939 A * 2/1997 Widener ..... 4/507
5,819,804 A * 10/1998 Ferrer et al. ..... 138/89
6,311,721 B1 * 11/2001 Aaron ..... 137/363
6,353,971 B1 * 3/2002 Krawczyk ..... 16/412

FOREIGN PATENT DOCUMENTS

DE 298 20 926 1/1999

* cited by examiner

*Primary Examiner*—Carl D. Friedman
*Assistant Examiner*—Chi Q. Nguyen
(74) *Attorney, Agent, or Firm*—Guido Modiano; Albert Josif; Daniel O'Byrne

(57) ABSTRACT

A device for protecting lifting inserts having a tubular body during embedding in a concrete component, comprising an elastically deformable element insertable in the axial end of the tubular body of the lifting insert directed toward the outside of the prefabricated component engageable for lifting the prefabricated component. The elastically deformable element occupies an axial portion of the tubular body starting from axial end. The device comprises expansion elements, which act on the elastically deformable element to cause a radial expansion thereof through the elastically deformable element engaging whereby the inside walls of the tubular body to prevent infiltration of concrete through the axial end of the tubular body of the lifting insert.

15 Claims, 3 Drawing Sheets

DEVICE FOR PROTECTING LIFTING INSERTS HAVING A TUBULAR BODY DURING THEIR EMBEDDING IN A PREFABRICATED CONCRETE COMPONENT

BACKGROUND OF THE INVENTION

The present invention relates to a device for protecting lifting inserts having a tubular body during their embedding in a prefabricated concrete component.

Lifting inserts are known which are substantially constituted by a tubular body that is embedded in the concrete body of a prefabricated component during its production, so that an open axial end of the insert is flush with one face of the component or in any case proximate to one face of the component, so that an element to be used to lift the component can be inserted in such axial end.

In order to allow insertion of such element in the tubular body, at least one inner portion of the tubular body, starting from said axial end thereof, must be free from concrete. For this reason, during the production of the prefabricated component it is necessary to take particular care so that the concrete does not invade the internal portion of the tubular body designed to receive said element.

A lifting insert of the above cited type is disclosed in U.S. Pat. No. 6,092,849 by the same Applicants. Such lifting insert is substantially constituted by a tubular body in which an axial portion of its extension is flattened, starting from the axial end that must be accessible by the element for lifting the component, while the remaining part has a circular transverse cross-section.

The transition from the flattened portion to the portion having a circular cross-section defines a pair of axial shoulders, with which the element to be used for lifting engages. In order to increase the surface of these axial shoulders, the flattening of the tubular body at said transition can be considerable.

The element to be used for lifting has a hammer-like head, which can be inserted through the flattened axial end until it moves beyond the axial shoulders. After insertion, the element is turned about the axis of the tubular body with respect thereto, through an angle of substantially 90°, so that the two lobes of the hammer-like head face the two axial shoulders of the tubular body. The element is then locked rotationally with respect to the tubular body and its end arranged opposite the hammer-like head, which remains outside the tubular body and is slot-shaped, can be engaged by a hook of a lifting machine in order to lift the component.

Lifting inserts of this kind are generally provided in the formworks to be used to produce the prefabricated components, before pouring the concrete. Depending on the component to be manufactured, these lifting inserts can be associated with the sides of the formworks so that the axis of the tubular body is horizontal or can be suspended from cross-members or other horizontal supporting elements that lie between two opposite sides of the formworks.

In order to protect the inner portion of the lifting insert designed to receive the element to be used for lifting, a plug made of spongy material is used and is inserted beforehand in the tubular body.

The plug made of spongy material has the problem that due to its deformability it does not ensure a sufficient seal against the passage of concrete, which often invades the inside of the lifting insert, entailing manual interventions to remove it.

The tubular body is fixed to the sides of the formwork or suspended with often improvised manual methods, which do not always achieve the intended precision in the positioning of the lifting insert in the body of the prefabricated component.

SUMMARY OF THE INVENTION

The aim of the present invention is to solve the above mentioned problems, by providing a protection device for lifting inserts having a tubular body that avoids with absolute safety the infiltration of concrete, during the production of the prefabricated component into which the lifting insert is embedded, in the portion of the lifting insert that is designed to accommodate the element to be used for lifting the component.

Within the scope of this aim, an object of the invention is to provide a protection device that has a high mechanical strength and can be reused several times.

Another object of the invention is to provide a protection device that can also be used to support and position, with excellent precision, the lifting insert inside the formworks for the formation of the components.

Another object of the invention is to provide a protection device that is extremely simple and easy to use.

This aim and these and other objects that will become better apparent hereinafter are achieved by a device for protecting lifting inserts having a tubular body during their embedding in a prefabricated concrete component, characterized in that it comprises an elastically deformable element that can be inserted in the axial end of the tubular body of the lifting insert that is designed to be directed toward the outside of the prefabricated component and can be engaged by means for lifting the prefabricated component, said elastically deformable element being suitable to occupy an axial portion of said tubular body starting from said axial end, expansion means being provided which act on said elastically deformable element in order to cause a radial expansion thereof that engages said elastically deformable element with the inside walls of said tubular body in order to prevent the infiltration of concrete through said axial end of the tubular body of the lifting insert.

BRIEF DESCRIPTION OF THE DRAWINGS

Further characteristics and advantages of the invention will become better apparent from the description of some preferred but not exclusive embodiments of the protection device according to the invention, illustrated only by way of non-limitative example in the accompanying drawings, wherein.

DESCRIPTION OF THE PREFERRED EMBODIMENTS

Figure 1:
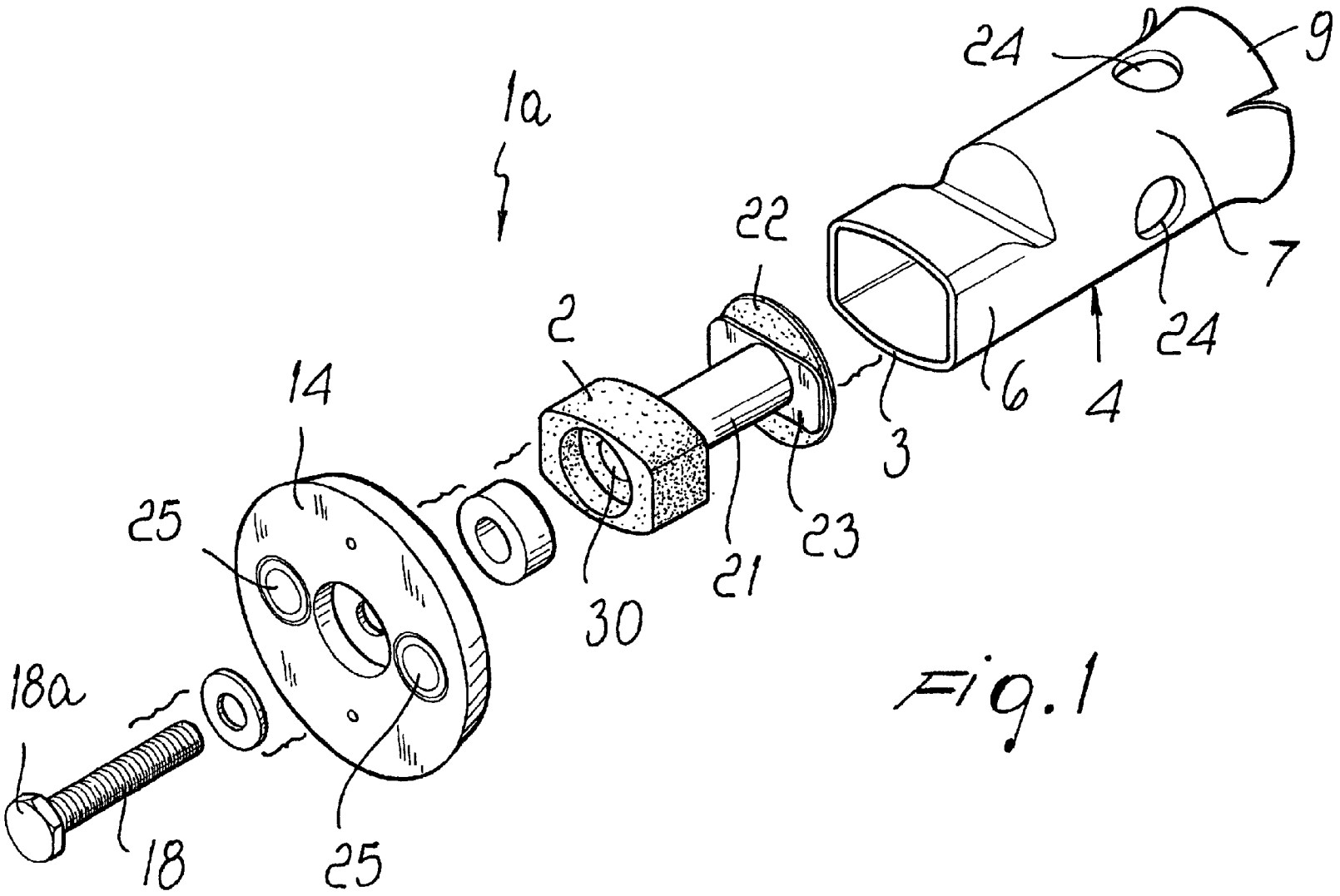
FIG. 1 is an exploded perspective view of the protection device according to the invention, in a first embodiment, and of the lifting insert in which it is to be inserted.

With reference to the figures, the device according to the invention, generally designated by the reference numerals 1*a*, 1*b*, 1*c*, 1*d*, 1*e* in its various embodiments, comprises an elastically deformable element 2, which can be inserted in the axial end 3 of the tubular body 4, 4*a* of the lifting insert that is designed to be directed toward the outside of the prefabricated component 5, i.e., the end that is designed to be engaged by the means for lifting the component 5.

The elastically deformable element 2 is suitable to occupy an axial portion of the tubular body 4, 4*a* starting from the axial end 3.

The device comprises expansion means, which act on the elastically deformable element 2 in order to cause a radial expansion thereof, so as to engage it hermetically with the internal walls of the tubular body 4, 4*a*, thus preventing the concrete, during the molding of the component 5, from being able to infiltrate through said axial end 3.

The lifting insert is constituted by a tubular body 4, 4*a* in which an axial portion 6 of its extension, starting from the axial end 3, is flattened, while the remaining part 7 of the tubular body has a substantially circular cross-section. In this manner, in the region of transition between the portion 6 and the part 7 there are two axial shoulders 8 that can be engaged by the hammer-like head, inserted through the portion 6 and then turned about the axis of the tubular body, of an engagement element to be used to lift the component 5.

Substantially, the lifting insert can be of the type disclosed in U.S. Pat. No. 6,092,849.

Figure 6:
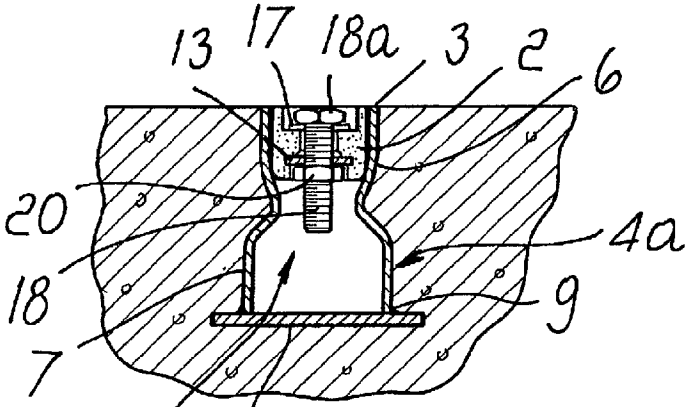
FIG. 6 is an axial sectional view of the device according to the invention in a fifth embodiment, coupled to another type of lifting insert during the formation of the prefabricated component in which it is embedded.

The tubular body 4,4*a* of the lifting insert can be open at both of its axial ends, designated by the reference numerals 3 and 9, as shown in FIGS. 1 to 5, in which the lifting insert has been designated by the reference numeral 4, or the axial end 9 can be closed, for example by a welded plate 10, as shown in FIG. 6, in which the lifting insert has been designated by the reference numeral 4*a*.

The elastically deformable element 2 has a shape that corresponds to the internal shape of the axial portion 6 of the tubular body of the lifting insert 4, 4*a* in which it is to be inserted, but is slightly smaller before its radial expansion, so that it can be easily inserted or extracted through the axial end 3.

The elastically deformable element 2 is conveniently made of a rubber capable of withstanding the temperatures of concrete during the hydration step and of the optional step for curing with additional heating, usually at temperatures between 70 and 90° C.

The means for the radial expansion of the elastically deformable element 2 comprise two axial abutments 11 and 12, between which an axial portion of the element 2 is interposed. The expansion means further comprise traction means, which is connected to one of the abutments and acts on the other abutment in order to cause the movement of one abutment toward the other, thus producing the axial compression of the axial portion of the interposed element 2, with a consequent outward radial expansion of said axial portion of the element 2.

The abutment 11 is formed by a first plate 13, which is embedded in the element 2 proximate to the axial end designed to be inserted first in the tubular body of the lifting insert, i.e., the end that will be directed toward the end 9 of the tubular body.

The other abutment 12 is formed by a second plate, which rests, directly or with other elements interposed, against the axial end of the element 2 that, when said element is inserted in the insert 4, 4*a*, is substantially flush with the axial end 3 of the tubular body of the lifting insert 4, 4*a*.

Figure 2:
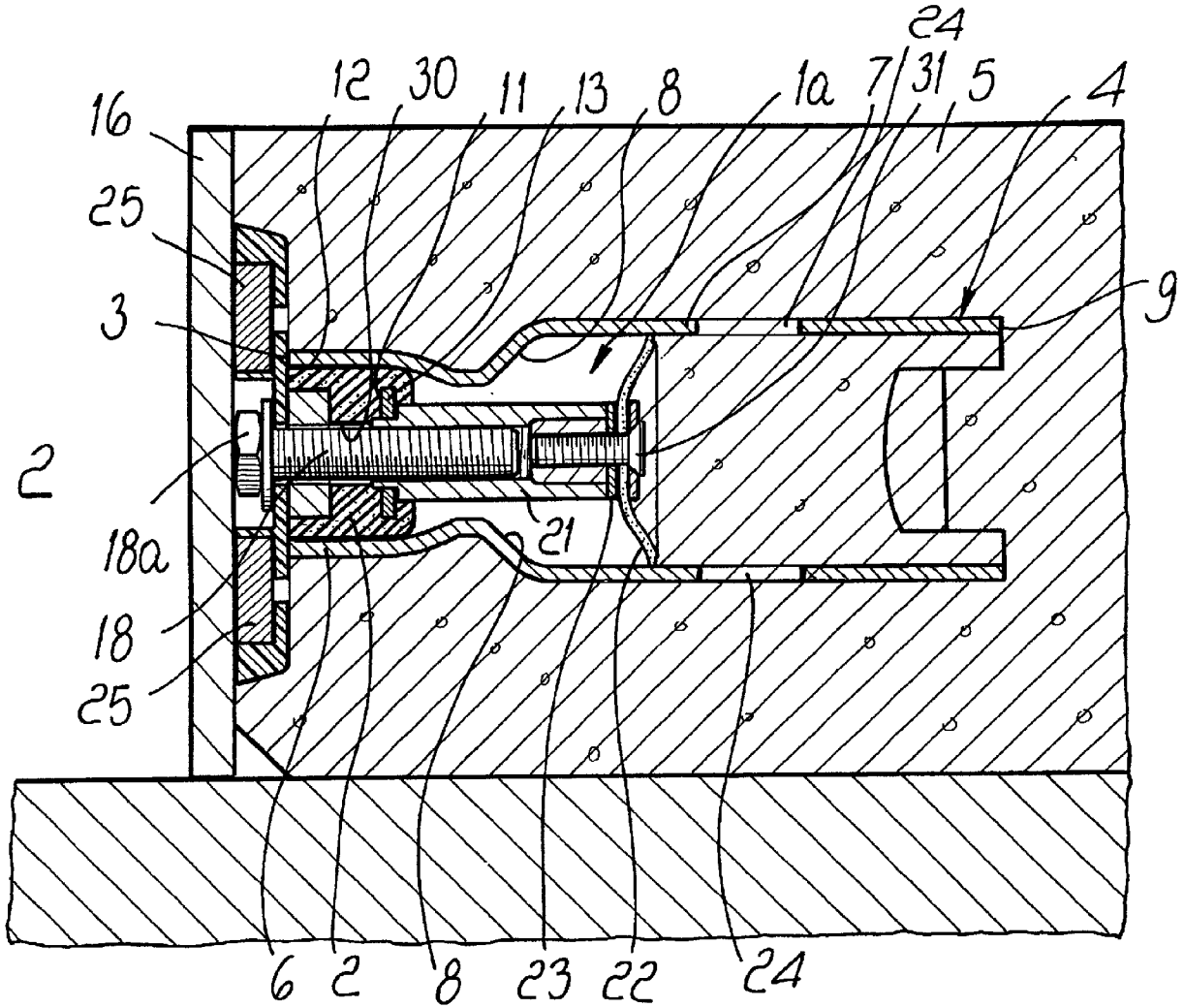
FIG. 2 is an axial sectional view of the protection device of FIG. 1, coupled to a lifting insert in a possible use for supporting the lifting insert in a formwork.
Figure 4:
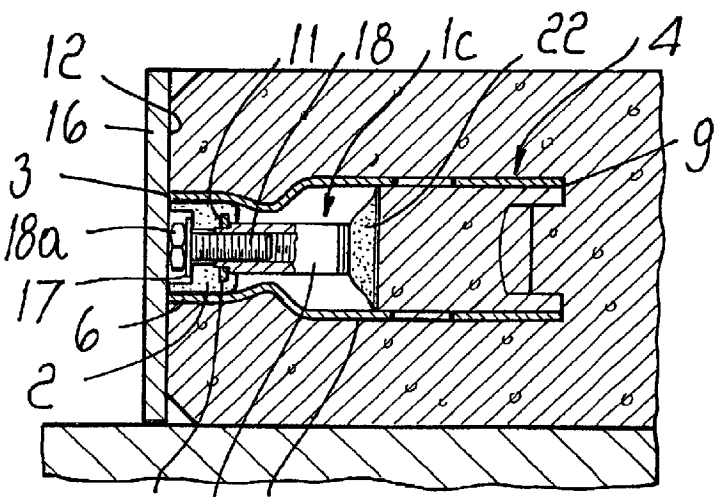
FIG. 4 is an axial sectional view of the protection device according to the invention in a third embodiment, coupled to a lifting insert in another possible use for supporting the lifting insert in a formwork.
Figure 3:
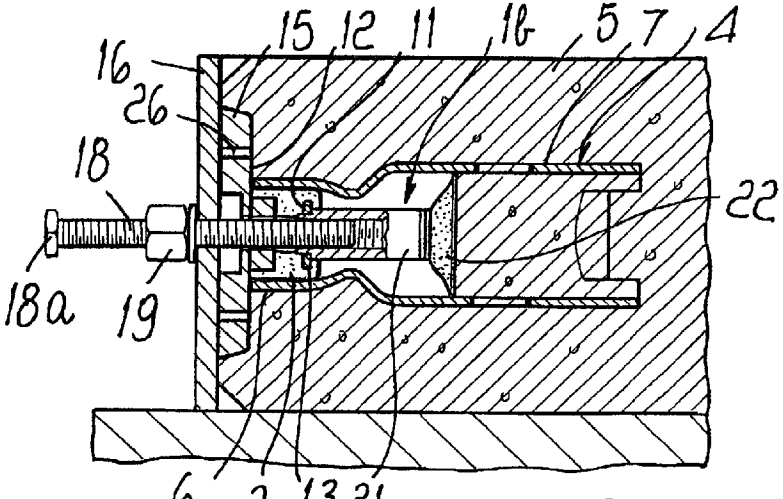
FIG. 3 is an axial sectional view of the protection device according to the invention, in a second embodiment, coupled to a lifting insert in another possible use for supporting the lifting insert in a formwork.
Figure 5:
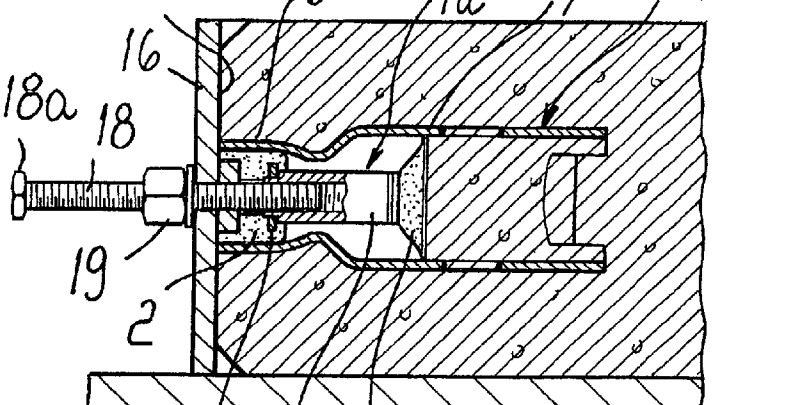
FIG. 5 is an axial sectional view of the protection device according to the invention in a fourth embodiment, coupled to a lifting insert in another possible use for supporting the lifting insert in a formwork.

In the various illustrated embodiments, said second plate is constituted by an actual disk-like plate 14, as shown in FIGS. 1 and 2; by a plate 15 and by a wall or side 16 of the formwork of the component 5, as shown in FIG. 3; by a washer 17, as shown in FIGS. 4 and 6; by a wall or side 16 of the formwork of the component 5, as shown in FIG. 5.

As an alternative, the abutment 12 can be formed simply by the head or by another axial shoulder, capable of abutting against the axial end of the element 2 located proximate to the end 3 of the tubular body, of the screw that constitutes the traction means.

The traction means comprises a screw 18, which rests, by means of its head 18*a* or by means of another axial shoulder provided along its extension (formed for example by a nut screwed 19 along the screw, as shown in FIGS. 3 and 5), against the side of the second plate that is directed away from the first plate 13.

As an alternative, the screw 18 can even rest directly, with its head 18*a* and with another axial shoulder, against the element 2, as mentioned above.

The screw 18 passes axially, with play, through an axial passage 30 formed in the element 2 and engages a threaded hole provided in the first plate 13 or in an element, for example a nut 20, which rests against the face of the first plate 13 that is directed away from the second plate.

Optionally, the element in which the threaded hole for the screw 18 is provided can be partially or fully embedded in the element 2.

Advantageously, in the embodiments shown in FIGS. 1 to 5, the element 2 is connected, with its end that lies closest to the first plate 13, i.e., its end designed to be inserted first in the tubular body of the lifting insert 4, to a shaft 21 provided with means that provides a seal against concrete, are spaced from the element 2, and can engage the inside of the tubular body of the lifting insert 4 in a region that is spaced axially from the end 3.

Said sealing means is preferably constituted by an elastically flexible disk 22 fixed coaxially to the shaft 21.

It should be noted that the disk 22 is fixed to the shaft 21 by means of a screw 31 so that it can be replaced rapidly when worn.

The disk 22 has a slightly larger diameter than the inside diameter of the portion 7 having a circular cross-section of the tubular body of the lifting insert 4, so as to adhere to the internal surface of the tubular body of the lifting insert.

Again in order to improve this adhesion, the disk 22 can have a step-like perimetric edge.

The disk 22 and the element 2, inserted in the lifting insert 4, delimit the axial portion of the tubular body of the lifting insert 4 that is designed to accommodate the lifting element and is isolated with absolute certainty from the concrete during the molding of the component 5.

Conveniently, on the side of the disk 22 that is directed toward the element 2 there are means for delimiting the flexural deformability of the disk 2, constituted for example by a supporting lamina 23 that is fixed to the shaft 21. The lamina 23 is designed to assist the disk 22 in withstanding without flexing the thrust of the concrete that enters the tubular body of the lifting insert 4 through the end 9 or through other openings 24 proximate to the end 9.

If the shaft 21 is provided, it rests with an axial shoulder against the face of the first plate 13 that is directed away from the second plate and the threaded hole for the screw 18 is formed coaxially in the shaft 21.

The device according to the invention also comprises means for connecting the element 2 to the formwork of the prefabricated component 5.

Said connection means can be constituted by the very screw 18 or by an extension thereof, as shown in FIG. 5, which engages, by passing through a preset hole, a wall or shoulder 16 of the formwork.

As shown in FIGS. 1 and 2, the connection means, if the walls or shoulders 16 of the formwork are made of ferromagnetic material, can be constituted by permanent magnets 25 applied to the second plate 14 in order to engage said second plate 14 with the inner side of the wall or shoulder 16.

The connection means can also be constituted by nails, screws or rivets, through which the second plate 15, optionally provided with holes 26 for this very purpose, is applied to the wall or sides 16 of the formwork.

The use of the protection device according to the invention is as follows.

The element 2, which has not yet expanded radially, is inserted in the end 3 of the tubular body of the lifting insert. If the disk 22 is provided, it flexes elastically while passing through the portion 6 and then engages, by elastic reaction, with its perimetric edge against the internal surface of the tubular body of the lifting insert.

Once the insertion of the element 2 has been completed, by acting on the screw 18, the element 2 is made to expand radially, adhering to the internal surface of the portion 6 of the tubular body of the insert.

In the embodiments shown in FIGS. 1, 2, 3, 4 and 6, the radial expansion of the element 2 is achieved by tightening the screw 18, while in the embodiment shown in FIG. 5 the radial expansion of the element 2 is achieved by acting on the nut 19.

The engagement of the element 2 with the internal surface of the tubular body of the lifting insert rigidly couples the lifting insert to the screw 18 and to any other elements associated with the screw 18 and with the element 2, such as the plate 14 or the plate 15. All these elements can be used to position and support the lifting insert in the formwork of the component 5.

The engagement of the element 2 and of the optional disk 22 with the internal surface of the tubular body prevents with absolute safety the penetration of concrete, during the molding of the component 5, in the region of the lifting insert that is designed to be engaged by the lifting element.

It should be noted that the plates 14 and 15, when provided, generate recesses on the face of the prefabricated component 5 at the lifting insert 4, 4*a*. Said recesses are designed to be filled with castings of cement mortar in order to conceal the lifting inserts once the prefabricated component has been fully installed.

Once the prefabricated component 5 has stabilized, by acting on the screw 18 or on the nut 19 in reverse to what had been done earlier, a radial contraction is achieved, by elastic reaction, of the element 2, which can thus be extracted easily from the lifting insert.

In practice it has been found that the device according to the invention fully achieves the intended aim and objects, since it avoids with absolute safety infiltrations of concrete, during the production of the prefabricated component, in the region of the lifting insert that is designed to accommodate the element to be used for lifting the component.

Although the device according to the invention has been conceived particularly for lifting inserts of the type disclosed U.S. Pat. No. 6,092,849, it can also be used with other types of lifting insert provided with a tubular body.

The protection device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2000A002794 from which this application claims priority are incorporated herein by reference.

What is claimed is:

1. A device for protecting lifting inserts having a tubular body, engageable by lifting means, during embedding thereof in a prefabricated concrete component, comprising: an elastically deformable element insertable in a first axial end of the tubular body of a lifting insert arranged to be directed outside from the prefabricated component for engagement with the lifting means, said elastically deformable element being provided so as to accommodate in an axial portion of said tubular body starting from acid first axial end; expansion means for acting on said elastically deformable element to cause an axial compression thereof and a radial expansion thereof making said elastically deformable element engage inside walls of said tubular body in order to prevent infiltration, of concrete through said first axial end of said tubular body of the lifting insert, sealing means being further provide downstream of said elastically deformable element, connected spaced with respect to said deformable element and adapted to circumferentially abut against inner wall of said tubular body, said expansion means comprising two axial abutments and wherein a first one of said axial abutments is formed by a first plate, which is embedded in said elastically deformable element, proximate to a first axial end thereof arranged to be inserted first in the tubular body of the lifting insert.

2. The device of claim 1, wherein said elastically deformable element is shaped so as to be coupled with play, prior to radial expansion thereof, to said axial portion of the tubular body of the lifting insert.

3. The device of claim 2, comprising traction means, at least one axial portion of said elastically deformable element being interposed between said axial abutments, said traction means being connected to a first one of said axial abutments and acting on a second one of said abutments, in order to move a first one of said abutments toward the second one, with consequent radial expansion of said at least one axial portion of a said elastically deformable element interposed between said abutments.

4. The device of claim 1 wherein the second one of said axial abutments is formed by a second plate, which rests against a second axial end of the elastically deformable element.

5. The device of claim 4, wherein said traction means comprises a screw, having a head or an axial shoulder provided therealong, which rests against a side of said second plate that is directed away from said elastically deformable element and passes with play through an axial passage of said elastically deformable element, said screw engaging a threaded hole formed in any of said first plate and an element that rests against a face of said first plate that is directed away from said second plate.

6. The device of claim 5, comprising a shaft supporting said sealing means that provide a seal against concrete, said elastically deformable element being connected, through the first end thereof that lies closest to said first plate, to said shaft that supports said sealing means, is spaced by said elastically deformable element, and is arranged so as to be engageable inside said tubular body, in a region that is spaced from said first axial end of the tubular body in order to close, in cooperation with said elastically deformable element, said tubular body at a portion thereof which is engageable by said lifting means.

7. The device of claim 6, wherein said sealing means comprises an elastically flexible disk that is supported coaxially by said shaft.

8. The device of claim 7, wherein said disk has a step-like perimetric edge.

9. The device of claim 6, comprising limiting means for limiting flexural deformation of said disk.

10. The device of claim 6, comprising connection means for connecting said elastically deformable element to a formwork of the prefabricated component.

11. The device of claim 10, wherein said connection means is constituted by said screw of said traction means.

12. The device of claim 10, wherein said connection mans is constituted by said screw of said traction means, said second plate being constituted by a wall of the formwork that is crossed by said screw.

13. The device of claim 12, wherein said connection means is interposed between said second plate and a wall of the formwork.

14. The device of claim 10, wherein said connection means comprises permanent magnets that are applied to said second plate, said permanent magnets being provided so as to engage a ferromagnetic wall of the formwork.

15. The device of claim 10, wherein said screw of the traction means engages a threaded hole formed in said shaft, said shaft engaging against the face of said first plate that is directed away from said second plate.

* * * * *